US006718563B1

(12) United States Patent
Kreiensieck

(10) Patent No.: US 6,718,563 B1
(45) Date of Patent: Apr. 13, 2004

(54) SPILL PROOF SPITTOON CUP

(76) Inventor: John B. Kreiensieck, 2740 Raintree Cir., Tallahassee, FL (US) 32308

( * ) Notice: Subject to any disclaimer, the term of this patent is extended or adjusted under 35 U.S.C. 154(b) by 0 days.

(21) Appl. No.: 10/341,641

(22) Filed: Jan. 14, 2003

(51) Int. Cl.[7] ..... A61J 19/00
(52) U.S. Cl. ..... 4/258; 4/259; 4/267
(58) Field of Search ..... 4/258, 259, 267, 4/282–285

(56) References Cited

U.S. PATENT DOCUMENTS 4,628,547 A 12/1986 Baker ..... 4/259
4,908,882 A * 3/1990 Williams et al. ..... 4/261
5,396,664 A 3/1995 King, Jr. ..... 4/259
5,832,543 A 11/1998 Bosserman ..... 4/259

* cited by examiner

*Primary Examiner*—Charles E. Phillips

(57) ABSTRACT

The present invention is a novel and unique spill proof portable spittoon cup device. The device is comprised of a cup like container and a snap-on lid. The container includes an open top and a closed bottom. The closed bottom of the cup also features a separate storage component for snuff or the like. In addition, the device of the present invention is comprised of a separate snap-on lid. The snap-on lid is formed to be removably secure the lid to the top of the cup like container and incorporates a folding spout which passes therethrough and into the cup like container. A check valve float on the cup like container located on the container side of the snap-on lid is designed and configured to allow fluid into the cup while also providing for air to be relieved out through the check valve float.

4 Claims, 3 Drawing Sheets

SPILL PROOF SPITTOON CUP

BACKGROUND OF THE INVENTION

1. Field of the Invention

The present invention relates generally to a portable spittoon cup device which is designed and configured to be spill proof, attractive, functional and convenient; and more particularly to a novel and unique portable spittoon cup which provides for a snap-on lid on the cup device with a folding spout and a check valve float which will allow air to be relieved from the cup device and allows fluid to enter the cup, while also providing for convenient snuff storage capability.

2. Description of the Prior Art

Portable spittoon devices are well known in the prior art. For example, U.S. Pat. No. 5,832,543 issued to Bosserman provides for a disposable portable pocket spittoon comprising a container having a top access opening and features a fill funnel which is inserted through the top open end and suspended within the container in order to direct spittle within the container. In addition, U.S. Pat. No. 5,396,664 issued to King, Jr. provides for a portable cuspidor which includes a spittle container, a removable funnel section and a cap which may also be used for storage of tobacco or the like. Also, U.S. Pat. No. 4,628,547 issued to Baker discloses a pocket cuspidor, which provides for a mouthpiece connected to a small portable container.

Accordingly, it is seen that there exists a need for a spill proof portable spittoon device, which is attractive, functional, convenient to use and also provides for the storage of snuff or the like. Ideally, the device of the present invention should encompass sanitary features, which are designed and configured to alleviate the possibility of spillage as well as odor or the like. The previous portable spittoon devices of the prior art, as identified above, fail to provide the benefits intended with the present invention, such as providing for spill proof design, attractive, functional, and convenient user-friendly features. Additionally, prior techniques do not suggest the present inventive combination of component elements as disclosed and claimed herein. The present invention achieves its intended purposes, objectives and advantages over the prior art device through a new, useful and unobvious combination of component elements, which are simple to use, at a reasonable cost to manufacture, assemble, test and by employing only readily available materials.

SUMMARY OF THE INVENTION

The present invention is a novel and unique spill proof portable spittoon cup device, which is designed and configured to provide for an attractive, functional and convenient user-friendly device. This device of the present invention is comprised of a cup like container and a snap-on lid. The container includes an open top and a closed bottom and a surrounding wall structure that extends up from the bottom. The closed bottom of the cup also features a separate storage component for snuff or the like. In addition, the device of the present invention is comprised of a separate snap-on lid. The snap-on lid is formed to be removably secure the lid to the top of the cup like container and incorporates a folding spout which passes therethrough and into the cup like container. A check valve float on the cup like container located on the container side of the snap-on lid is designed and configured to allow fluid into the cup while also providing for air to be relieved out through the check valve float. In addition, if the cup container device of the present invention is tipped up-side down or if the fluid level inside the cup like container device reaches the check valve float, then the check valve float will close, thereby preventing spillage. Thus, the device of the present invention may be carried in any convenient means including an optional handle, which is connected to the cup like container.

The device of the present invention provides for a convenient and functional user-friendly disposal means for the contents of the cup like container device via flushing with water.

Accordingly, it is the object of the present invention to provide for a spill proof portable spittoon device, which is designed and configured to be attractive, functional, and convenient to the user, which will overcome the deficiencies, shortcomings, and drawbacks of prior spittoon cup like devices and methods thereof.

It is yet another object of the present invention to provide for a snap-on lid on the spittoon cup device, which features a folding spout and a check valve float.

Still another object of the present invention is to provide for a spill proof portable spittoon cup device which is versatile, aesthetically pleasing and user friendly.

Still a further object of the present invention, to be specifically enumerated herein, is to provide for a spill proof portable spittoon device in accordance with the preceding objects and which will conform to conventional types of manufacture, be of simple construction and easy to use so as to provide a device that will be economically feasible, long lasting and relatively trouble free in operation.

Although there have been other inventions related to spittoon cup-like devices, none of these inventions provide the benefits of the present invention. The present invention meets the requirements of functionality, simple design, compact size, low initial cost, low operating cost, ease of use and manageability, and easy to use to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention taken in conjunction with the accompanying drawings.

DESCRIPTION OF THE PREFERRED EMBODIMENTS

Figure 1:
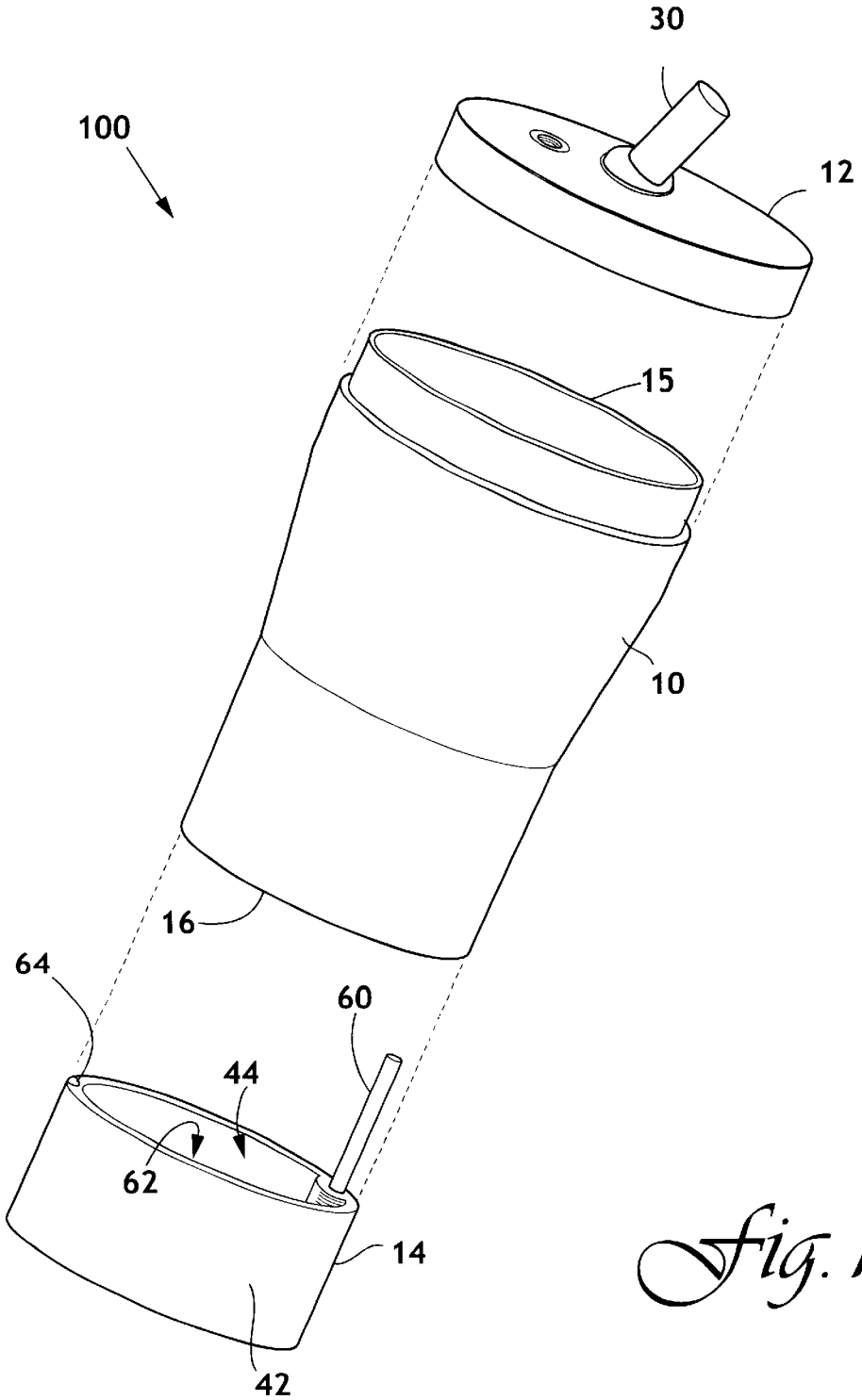
FIG. 1 is a perspective view of one embodiment of the invention, shown with the distinct elements separated for clarity.

FIG. 1 is a perspective view of one embodiment of the present invention. The major components of the device are a cup-like container 10 and snap-on lid 12 and a storage bottom 14. In the figure, these elements are shown separated for clarity. In use, the snap-on lid 12 is retained in removable fashion on the open end 15 of the container 10 to effectively close the open end 15. The storage bottom 14 is removably secured to the opposing bottom end 16 of the container 10.

Figure 2:
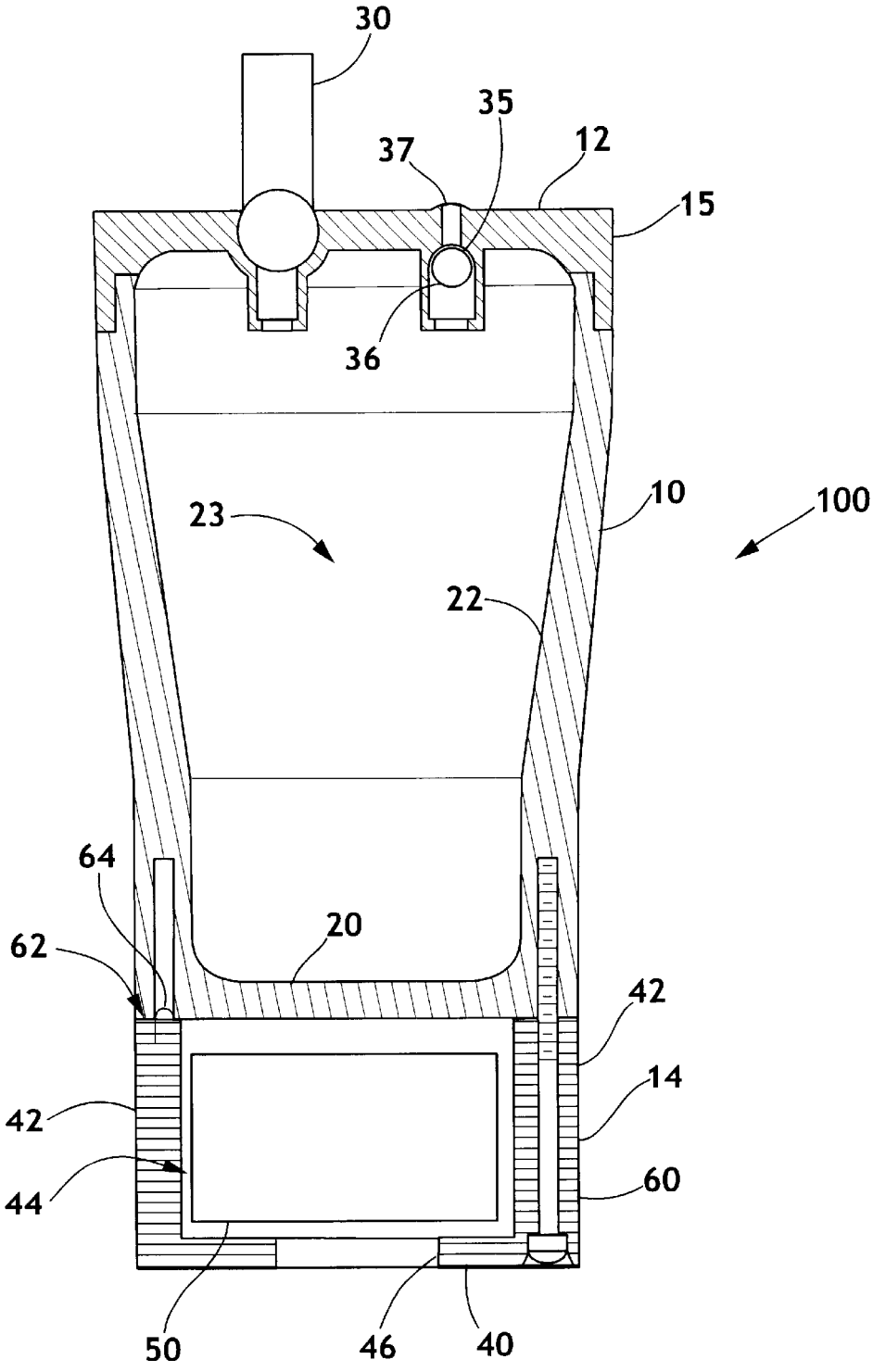
FIG. 2 is a cross-sectional view of the assembled embodiment of FIG. 1.

FIG. 2 is a cross-sectional view of the embodiment of FIG. 1. The container 10 includes a bottom 20 from which extends a circular wall 22 to the open end 15 to form a cavity 23. The dimensions of the container are not critical except for the requirement that it be easily grasped and useable by one hand. The cavity 23 is closed at the open end 15 by the lid 12 secured to the open end 15 in air-tight fashion. Both the open end 15 and lid 12 are preferably circular in cross-section to provide simplicity of fit. The respective mating surfaces of the container 10 and lid 12 preferably engage in a snap-on manner with their respective diameters having a sliding fit. Alternatively, and less preferably, their engagement may be by threads. In all configurations, the lid should be leak-proof and easily removed and remounted.

The lid 12 includes a hollow elongated spout 30 which is foldably secured to the lid 12. The spout is configured to allow users, by pressing their lips about the spout end, to force liquid through a passage in the spout 30 into the container 10. The spout engagement with the lid 12 allows the spout 30 to fold downward to reduce its projection above the lid 12. The details of construction of such spouts are known to those skilled in the art. The lid 12 also includes an air check valve 35 as a means of releasing air from the container 10 while trapping any liquid contents within the container 10. One construction of the check valve includes a caged ball 36 which closes an aperture 37 in the lid 12 to prevent escape of liquid. The ball may be bouyant such it rises with the level of liquid contents to close the aperture and prevent overfilling.

Figure 3:
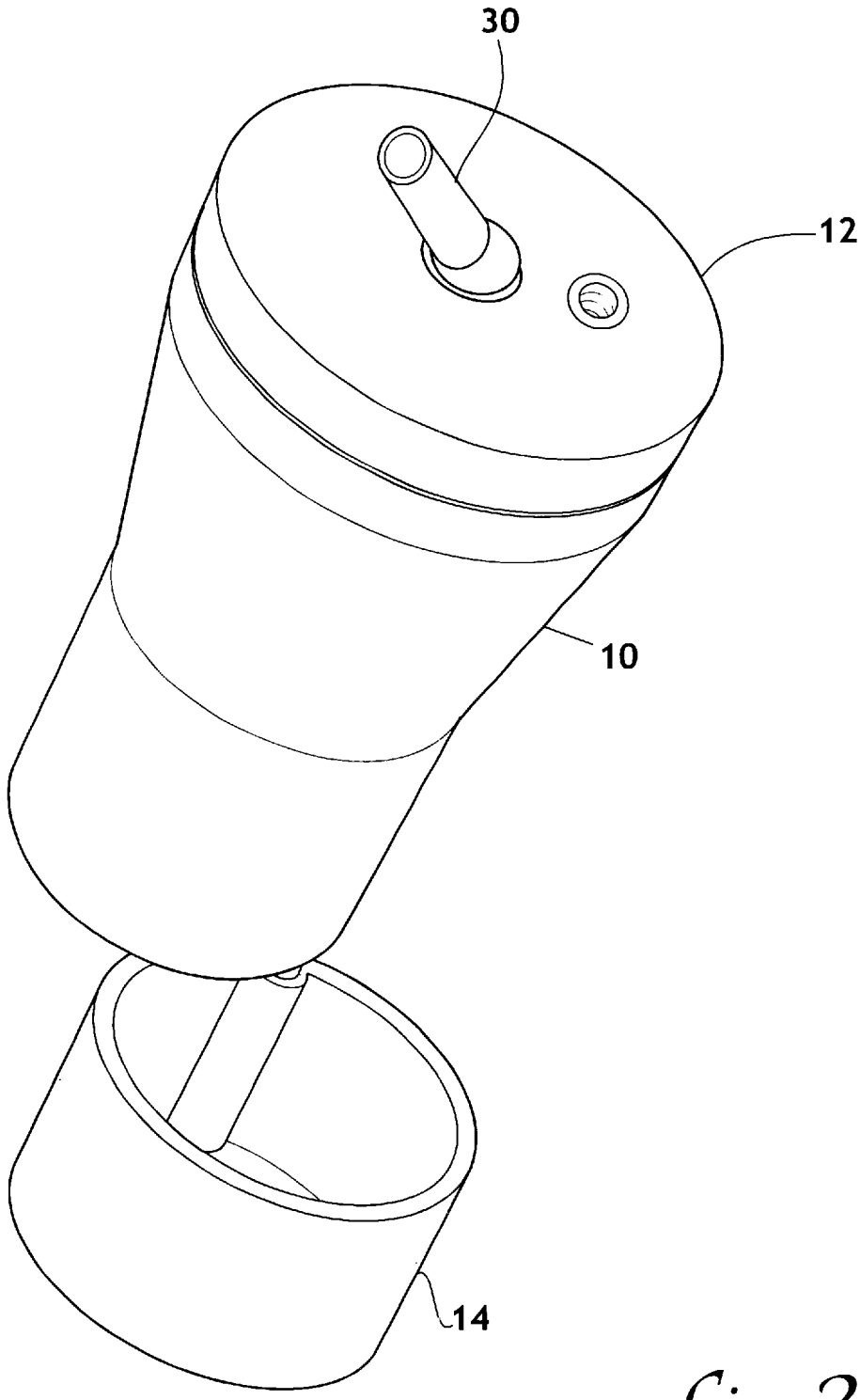
FIG. 3 is a perspective view of the assembled embodiment of FIG. 1 with the storage bottom rotated to a open condition for access.

For convenient storage of a quantity of snuff, the invention includes a storage bottom 14. The storage bottom is defined by a end cap 40 and extending side walls 42 which are sized to preferably fit smoothly aligned with the container bottom 20. The side walls also define a storage space 44. The storage space 44 is sized and configured to accept and retain a snuff can 50. Most marketed snuff products are available in a generally standard sized can for which the inventive storage space is preferably designed. To assist access and removal of the snuff can, the end cap includes a opening 46 sized to allow a user's finger to enter the storage space 44. In the embodiment shown, the storage bottom 14 is secured to the container 10 by a threaded fastener 60 which passes through the storage bottom and is received in a threaded hole in the container 10. The storage bottom 14 has a mating surface 62 which contacts the container 10. On the mating surface 62 is located a locking bump 64 sized and positioned to be received within a hole in the container 10 when the storage bottom 14 is properly aligned with the container 10. The combination of the fastener 60 and locking bump 64 provides a means of rotatably securing the storage bottom 14 to the container 10 to allow easy access to the storage space 44. In use, to secure the storage bottom, the fastener 60 is tightened sufficiently to retain the bump 64 within the hole, but sufficiently loosely to allow the storage bottom to be rotated, by hand, about the fastener 60 while the bump 64 is elastically displaced out of the hole. The height of the bump is, in part, determined by the particular materials used; however, a bump height of 1/32 to 1/16 inch will be successful in most designs to accomplish the stated functions. FIG. 3 illustrations the condition of the storage bottom rotated to an open and accessible configuration. After the user inserts a snuff container or accesses previously stored snuff, the storage bottom may be rotated back to its retained position. Alternative means of rotatably securing the storage bottom to the container are also contemplated. The invention includes a kit having a spill proof cup as above combined with a snuff can and a quantity of snuff disposed within the storage bottom.

The container and storage bottom may be formed of any of a variety of materials including metals and plastics. For aesthetic purposes, and low cost, the device is preferably formed of high density plastic. The preceding discussion is provided for example only. Other variations and embodiments of the claimed inventive concepts will become obvious to those skilled in the art. Adaptation or incorporation of known alternative devices and materials, present and future is also contemplated. The intended scope of the invention is defined by the following claims.

I claim:

1. A spill-proof snuff spittoon and snuff kit comprising;

a cup;

a lid removably secured to the cup, the lid having a hollow spout for forcing liquid into the cup and a valve for releasing air from the cup; and a storage bottom rotatably secured to the cup; and a quantity of snuff stored in the storage bottom.

2. A kit according to claim 1, and further comprising;

a snuff container sized to be received in the storage bottom.

3. A spill-proof spittoon providing for convenient storage and access of a quantity of snuff, comprising:

a cup;

a lid removably secured with a snap-on engagement to the cup, the lid having a hollow spout for forcing liquid into the cup and a valve for releasing air from the cup; and a storage bottom removably secured to the cup; and wherein:

the storage bottom has a storage space and is rotatably secured to the cup.

4. A spill-proof spittoon according to claim 3, and wherein:

the storage bottom has a projecting bump received in a hole in the cup; such that the storage bottom may be secured to the cup in an aligned manner in a first condition with the bump received in the hole; and rotated in a second open condition providing access to the storage space.

* * * * *